US005660390A

United States Patent [19]

Ginzburg et al.

[11] Patent Number: 5,660,390

[45] Date of Patent: Aug. 26, 1997

[54] ELECTION GAME APPARATUS BASED ON MULTIPLE PLAYER'S CHOICE

[76] Inventors: Eric J. Ginzburg; Eugenia Ginzburg, both of 635 St. Mary's Pkwy., Buffalo Grove, Ill. 60089

[21] Appl. No.: 369,143

[22] Filed: Jan. 5, 1995

[51] Int. Cl.[6] ..... A63F 3/00

[52] U.S. Cl. ..... 273/257

[58] Field of Search ..... 273/257, 279, 273/251, 252, 254

[56] References Cited

U.S. PATENT DOCUMENTS

| | | | |
|---|---|---|---|
| 391,715 | 10/1888 | Kellogg | 273/257 X |
| 476,146 | 5/1892 | Hunersdorff | 273/251 |
| 753,949 | 3/1904 | Wing | 273/279 |
| 1,616,216 | 2/1927 | Dempsey | 273/279 |
| 2,043,482 | 6/1936 | Lord | 273/257 |
| 2,930,621 | 3/1960 | Gross et al. | 273/257 |
| 4,643,429 | 2/1987 | Crandon et al. | 273/257 X |
| 4,784,394 | 11/1988 | Sumin | 273/251 |
| 5,288,076 | 2/1994 | Jackson et al. | 273/279 |
| 5,374,066 | 12/1994 | Ali | 273/279 |

FOREIGN PATENT DOCUMENTS

| | | | |
|---|---|---|---|
| 619894 | 3/1949 | United Kingdom | 273/251 |
| 726420 | 3/1955 | United Kingdom | 273/257 |
| 8103622 | 12/1981 | WIPO | 273/251 |

*Primary Examiner*—William E. Stoll

[57] ABSTRACT

A game apparatus simulating the Presidential Electoral campaign which includes a game board that comprises special paths serving for the movement of the players' tokens. These paths represent a simplified scheme of the U.S. interstate highways and airlines drawn on the background of a U.S. map. The main nodal points of these paths are the capitals of the States with a denoted number of votes for the Electoral College of a given State. These nodes stand for steps along the way to the players' goal of attaining the maximum number of votes which represents a majority in the Electoral College. All the remaining nodes of the paths serve for the players to demonstrate their skills to compete utilizing the proper strategy as well as to manifest the players' knowledge of American history, the U.S. Constitution and historical facts relating to the Presidency. The movement of players' tokens is realized by means of 3 dice that simulate candidates' transportation by car, train or airplane. A player can select the proper die in order to deliver his/her token to the State that he chooses.

1 Claim, 4 Drawing Sheets

HISTORICAL FACTS ABOUT PRESIDENTS

Question:

Which President was sworn into office on an airplane?

Fig 7a

Answer:

Lyndon B. Johnson

Fig 7b

PRESIDENTS AND HISTORICAL EVENTS

Question:

Who was President during the Korean War?

Fig 7c

Answer:

Harry Truman

Fig 7d

THE CONSTITUTION AND PRESIDENCY

Question:

Which Presidents signed the U.S. Constitution?

Fig 7e

Answer:

Washington and Madison

Fig 7f

BILL TO THE CONGRESS

General Tax Reduction support

Fig 8a

BILL TO THE CONGRESS

Welfare Reform veto

Fig 8c

BILL TO THE CONGRESS

A new crime bill

Fig 8b

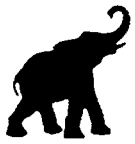

Fig 9a

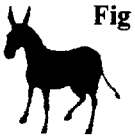

Fig 9b

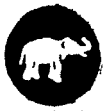

Fig 10a

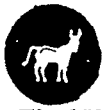

Fig 10b

ELECTION GAME APPARATUS BASED ON MULTIPLE PLAYER'S CHOICE

BACKGROUND OF THE INVENTION

1. Scope of the Invention

The scope of this invention relates to a board game apparatus and more particularly, pertains to an election game apparatus. The same applies to the representation of the judicial, legislative and election process (U.S. Patent Cl. 273–257 and 273–279).

2. Description of the Prior Art

There are some patents that simulate the Presidential Electoral Process and the Electoral College voting system. Some of these comprise only the elements of chance, while others comprise only the elements of strategy. Some of these games are very primitive, while others are too complicated for juniors and teenagers. Some of these comprise original ideas, while others are the compilation of previous inventions. We have listed the relevant patents relating to this topic and briefly comment on them:

U.S. Pat. No. 5,288,077 "Game of Presidents and the Electoral College Voting System" by Jerry F. Jackson and others, 1994. This game is similar in sense to a card game. It generates numbers of Electoral College votes for the States by the random selection of playing cards. This game has a very remote relation to the actual Presidential Election process.

U.S. Pat. No. 5,150,293 "Election Game Apparatus" by Flavio M. Cabrera, 1992. This game is the most advanced attempt to reproduce the Presidential campaign. The major difference between this board game and ours is in the game apparatus. In our invention there are no peripheral paths and, instead of this kind of path, there is a branched geometrical graph for the movement of the players' token (se below). This graph has much more variability than linear paths.

U.S. Pat. No. 4,709,926 "Electoral College Game" by Leo C. DiEdigo, 1986. This game contains some interesting features with respect to the advance of players as a function of events. However, the predominance of chance does not allow the players to use any strategy elements in order to win.

U.S. Pat No. 4,299,390 "Election Board Game with Campaign Promise Markers" by Raul J. Delgado and others, 1980. This game primarily uses known ideas about campaign promises (U.S. Pat. No. 3,525,526) as the motive force for the game. However, the usage of a predefined "campaign promise scoring value chart" seems to us a primitive evaluation mechanism. We suggest that the evaluation of candidates' promises can not be predefined and it depends upon the current social and political situation in the country. We propose in our invention to evaluate this important factor by voting for the prospective promised bills at the Electoral College Convention (see below).

U.S. Pat. No. 4,216,967, 4,118,036 and 4,092,028 "President Election Game" by Salvador Marse, 1978. These patents have the same differences with our invention described above.

Here are some other patents of game boards simulating the election process: U.S. Pat. No. 4,085,938 to Bean, Jr., 1976; U.S. Pat. No. 3,525,526 to Marie A. Kenrick, 1966; U.S. Pat. No. 1,907,255 to Ferrari Jr., 1933; U.S. Pat. No. 1,616,216 to Dempsey, 1927; U.S. Pat. No. 753,949, 1904; U.S. Pat. No. 398,233, to Jeanie P. Clarke and others, 1889. Because the term of these patents has expired, we can confirm that the major parts of the original ideas comprising these patents are essentially represented in the above descriptions.

As you can appreciate from the above, there continues to be a need for a new and improved election game apparatus that addresses both the problem of ease of use as well as providing both an element of chance and strategy and also simulating the various components of the actual political process involved in the Presidential Elections. We believe our invention substantially meets this need.

SUMMARY OF INVENTION

In view of the foregoing disadvantages inherent in the current types of game apparatus now existing, the present invention provides a new approach to the simulation of both Presidential and Primary Elections. This approach is based on the properties of the branched geometrical graph that consists of a number of cycles and trees. In such a graph, a player can reach the same node of the graph by different ways and therefore the game realizes an essential freedom of choice based on the decision of players. Thus, this approach combines the elements of both chance and strategy along with easy rules that are quite accessible to teenagers or even juniors.

We suggest this invented game apparatus simulates to some respect the Presidential and Primary Electoral processes of the United States. Therefore, our invention includes the following claims:

1. A game board (FIG. 1) consisting of a simplified scheme of US interstate highways that essentially recreates a branched geometrical graph (FIG. 2). The State capitals represent the main nodes of this graph, and the segments of the graph serve for the movement of players' tokens. The main nodes of the graph represent steps along the way to the goal of attaining the maximum number of votes which represents a majority in the Electoral College.

2. a set of 50 "State" cards which stands for the number of representatives in the Electoral College for each State, 3. three "special" dice that simulate the transportation of candidates through the country by car, train or airplane (FIG. 3).

4. "Victories and Defeats" cards simulating the relationships of the candidates with mass media (TV, Radio, Press) that are chosen by chance.

5. "Friends and Enemies" cards allowing the candidates to collect "friends" and also to avoid and neutralize "enemies". These cards are also selected by chance. Having friends a player can call upon them to help him/her to neutralize his enemies and also to protect against attacks by the mass media.

6. "Promises and Lobbyists" cards containing prospective bills that could potentially change the laws and effect the lifestyle of the country.

7. "funny money" that simulate campaign funds and the private donations that can cover the candidates' expenses during the course of the campaign.

8. cards with questions about the US Presidents separated into three groups relating to:

a. The US Constitution and the Presidency b. US Presidents & Historical Events c. Historical Facts about US Presidents 9. 100 suction cup markers with recognizable symbols for the two political parties in order to mark the occupied States and sources of donations.

a. die 1 (scores 1–3)—by car b. die 2 (scores 4–6)—by train c. die 3 (scores 7–12)—by airplane.

A player can select the proper die in order to stop his/her token on the State he chooses or nearby it.

Figure 1:
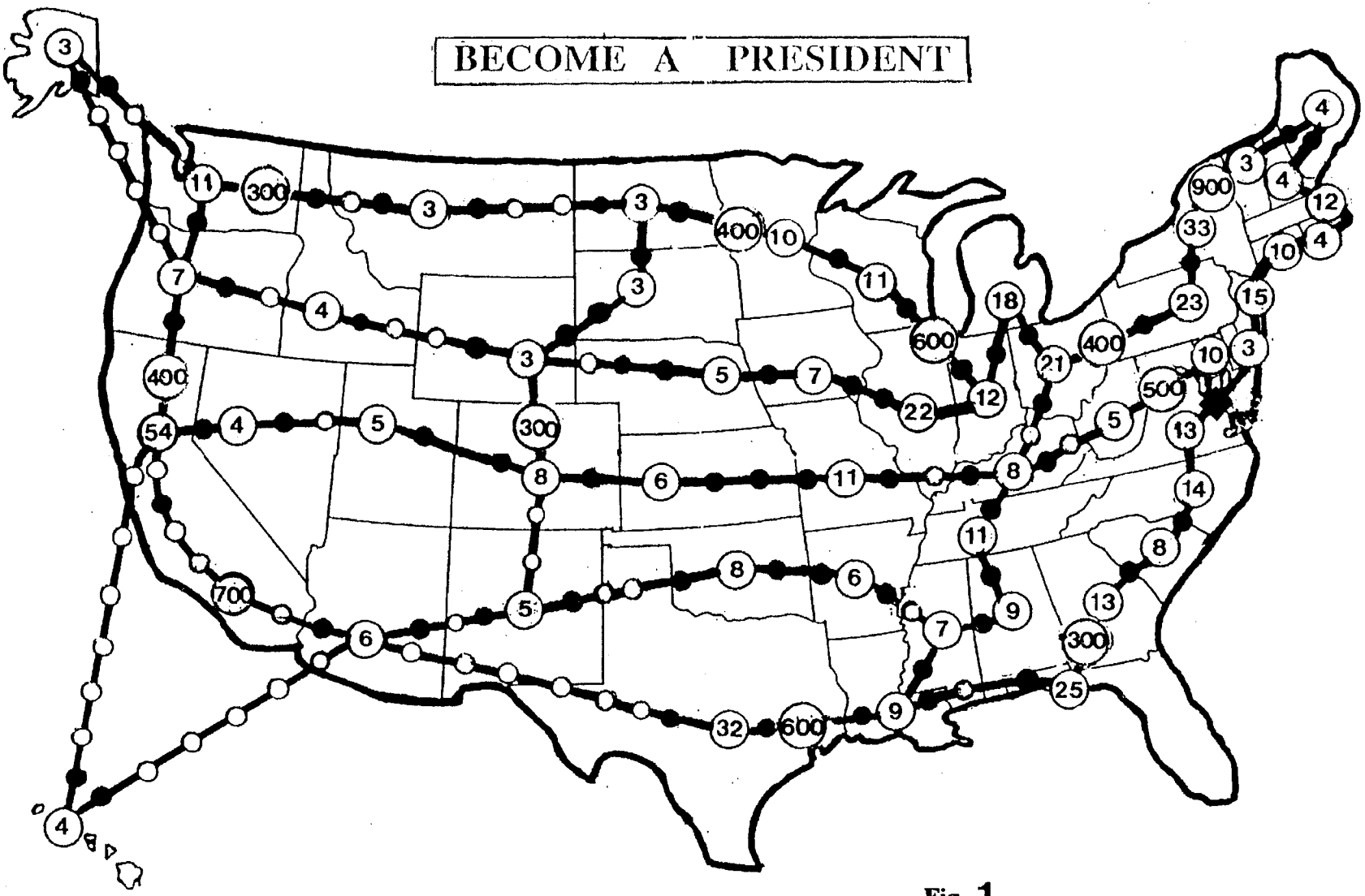
FIG. 1 is a game board that serve to process Presidential or Primary Elections.
Figure 2:
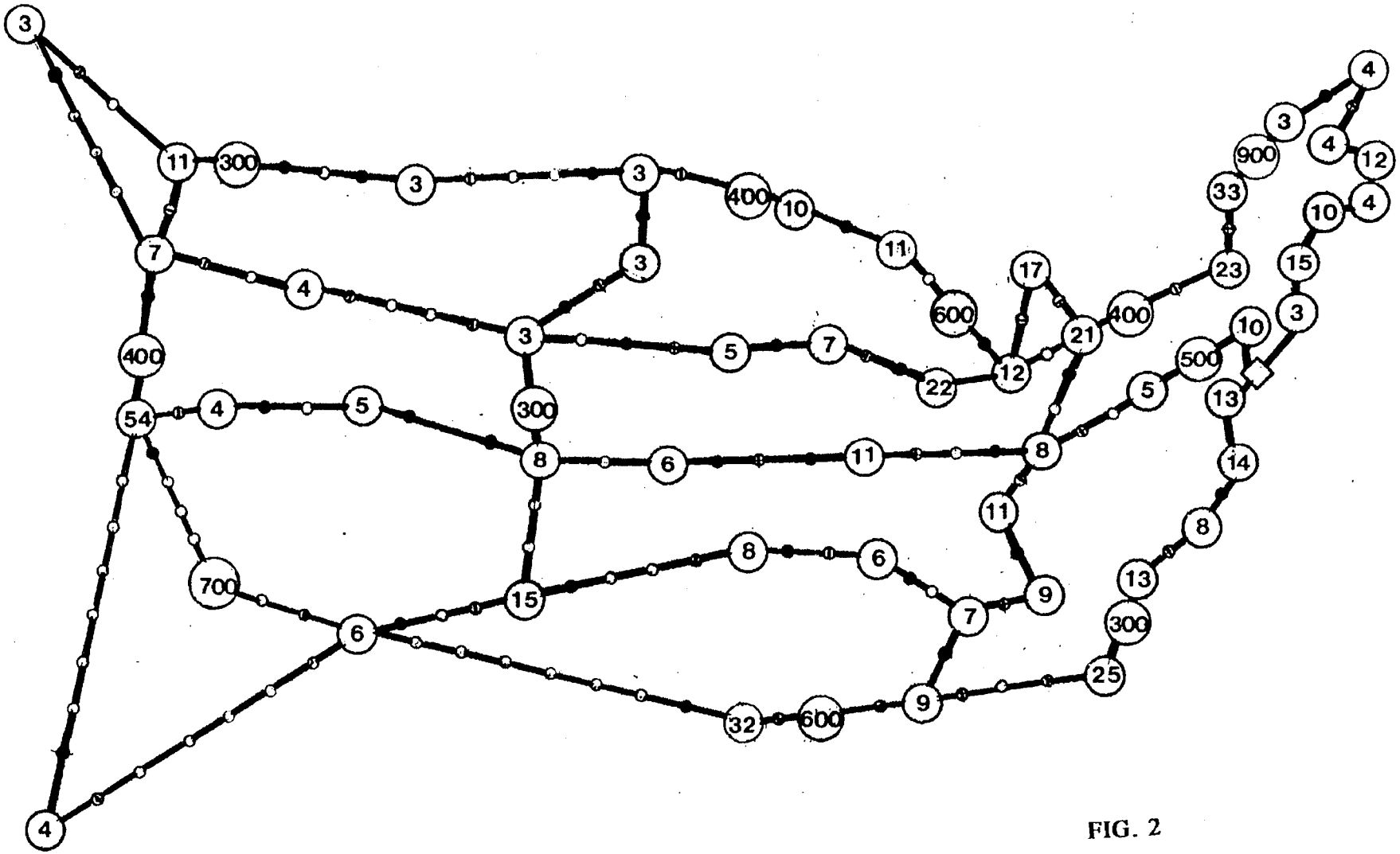
FIG. 2 is a skeleton scheme of paths for the movement of players' tokens.
Figure 3A:
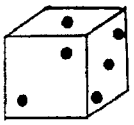
FIGS. 3*a*, 3*b*, and 3*c* illustrate a sample of "special" dice that simulate the transportation of candidates through the country.
Figure 3B:
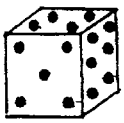
Figure 3C:
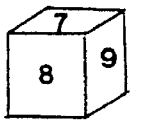
Figure 4:
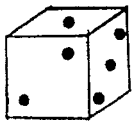
Figure 4:
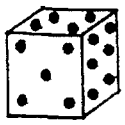
Figure 4:
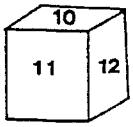
Figure 4:
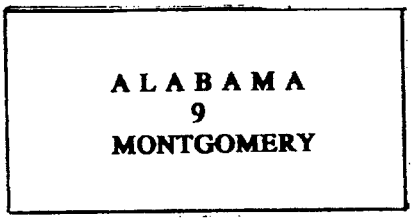

FIG. 4 illustrates a sample of State cards comprising state name, its capital and amount of votes in Electoral College.

Figure 5:
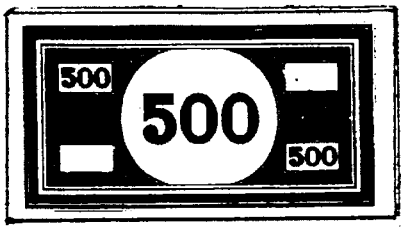
Figure 6A:
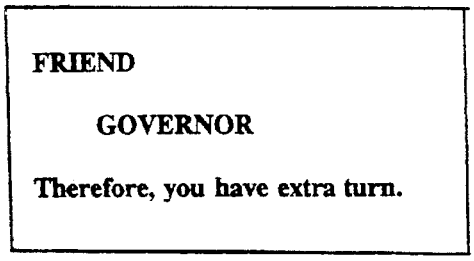
Figure 6B:
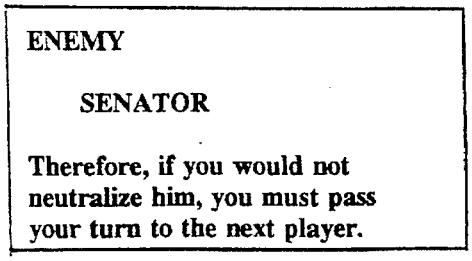
Figure 6C:
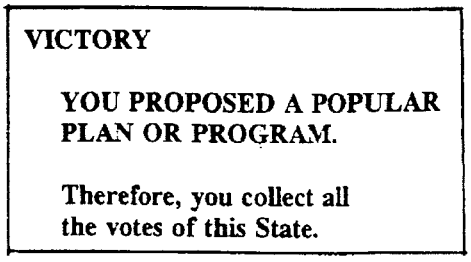
Figure 6D:
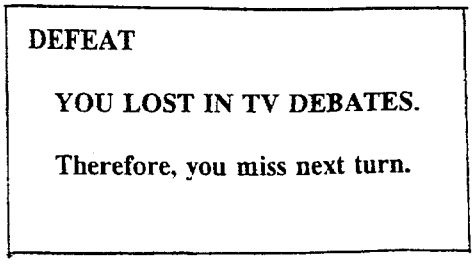

FIG. 5 illustrates a piece of play "funny" money.

FIGS. 6.1*a*, 6.1*b*, 6.2*a*, and 6.2*b* illustrate samples of instructive cards:

6.1 Friends/Enemies cards: a. Friend card, b. Enemy card;

6.2 Victories/Defeats cards: a. Victory card, b. Defeat card.

FIGS. 7.1*a*, 7.1*b*, 7.2*a*, 7.2*b*, 7.3*a*, and 7.3*b* illustrate samples of question/answer cards in three categories:

7.1 Presidents and Historical Events: a. front side - Question, b. reverse side - Answer;

7.2 Historical Facts about Presidents: a. front side - Question, b. reverse side - Answer;

7.3 The Constitution and the Presidency: front side - Question, b. reverse side - Answer.

FIGS. 8.1, 8.2, and 8.3 illustrate samples of Promise cards:

8.1 "Promises & Lobbyists" card that was marked by a red (support) marker;

8.2 "Promises & Lobbyists" card that was marked by a blue (veto) marker.

8.3 "Promises & Lobbyists" card of Lobbyist deck.

FIGS. 9.1 and 9.2 illustrate tokens of the players for two parties:

9.1 Republican party,

9.2 Democratic party,

FIGS. 10.1 and 10.2 illustrate "suction cup" markers for two parties:

10.1 Republican party,

10.2 Democratic party,

Below is the Detail Description of the game.

DETAILED DESCRIPTION OF THE INVENTED BOARD GAME

Setup

1. The players are divided into two or three parties with the following recognizable names:

a. Democrats b. Republicans c. Independent (only in the case of 3 players)

Note: If there are more than 3 players the Primary Election process is invoked before the Presidential Elections. In this case, one group is competing to select a democratic candidate and another group is competing to select a republican candidate for President.

2. A player selects one token for each player.

3. In the beginning of the game the electoral fund for each player is $1,000,000. This money is used by the player to spend for campaign purposes: travelling, meetings, banquets etc.

Note: A player can get additional money for the campaign because of donations by organizations and private funds (see Gameplay Rules below).

4. All players start in Washington, D.C. and move their token down either direction along the red paths over the US map.

5. For travel purposes, a player can use 3 dies. The prices for the 3 dice are the following:

| | Score | Pay |
|---|---|---|
| Car | 1–3 | $30,000 |
| Train | 4–6 | $50,000 |
| Airplane | 7–12 | $100,000 |

6. All players roll the die; the high roller goes first.

Gameplay Rules for Presidential Elections

1. A player selects a die paying the respective amount of money for its use.

2. A player rolls the die and moves the token along the chosen direction. For each turn a player may move the token only in the same direction. However, the consecutive two turns are independent, and a player can change his/her movement in either direction on the next turn.

3. If a player's token stops at a red circle, he/she collects all the votes of this State (along with a "State" card for a given State). A player that just collected the "State" card, marks this State with a symbol of his/her party: democrats—with a donkey, republicans—with an elephant, and independents—with a tiger (for example).

4. If the player's token stops at an orange circle, he/she collects as much money as denoted on this circle, and marks this source of money by his party symbol. After this time, this source of money is not accessible to any other player, and it should be considered as an interim point in the players' token movement.

Note: If a player has fully exhausted his/her electoral fund before the end of the campaign, the player can continue the game with a credit of 5 turns. During these turns the player should get a valid source of donations and payoff his/her debt, otherwise he will be forced to cease his/her campaign.

5. If a player's token stops at a green circle, the player draws a "Friends and Enemies" card from the deck. There are three alternatives on how to process it:

a. if a player draws a "Friend" card, he/she collects this card and immediately gets an extra turn, b. if a player draws an "Enemy" card he/she also collects this card but must pass his/her turn on to the next player.

c. if a player draws an "Enemy" card, but he/she has previously collected an associated "Friend" card, the player can neutralize this "Enemy" card with the associated "Friend" card. In this event, he/she returns the both cards to the deck and immediately gets an extra turn.

Note: Collected Friend & Advisors Cards keep their validity for the entire period of the game. These cards can protect a candidate from possible attacks of mass media, thereby keeping his/her turn and therefore allowing the player to improve his/her chances to become a President.

6. If a player's token stops at a blue circle, he/she collects a "Victories and Defeats" card, which determines a player's relationship with mass media (TV, Radio, Press).

The rules for the "Victories and Defeats" are described in the following:

a. If a player draws from the deck a "good" card (and the State has not yet been occupied by any other player)

he/she collects all the votes for this State. If the State has already been occupied, this event allows the player to immediately get an extra turn.

b. If a player draws from the deck a "negative" card he misses his next turn. However, if a player has previously collected an associated friends from the "Friends and Enemies" cards he/she can be protected from losing his/her turn. In this case, the player can return the relevant "Friends" cards to the deck and therefore keep his/her next turn. The detailed instructions for these choices are pointed out directly on the "Victories and Defeats" cards.

7. If a player's token stops at a red circle in a State that has already been collected by him/her, a player immediately gets an extra turn. If a player's token stops at a red circle in a State that has already been collected by another player, the given player must pass his/her turn on to the next player.

Winning the Game

1. While playing the game, each player counts the sum of collected votes.

2. A player who has already collected 268 votes is a winner of the game and he/she is declared as a Game President.

3. If none of the players have collected 270 votes (for example, in the case of three players), the player with the maximum votes is declared as the Game President.

4. The newly elected President's name is placed into the Gallery of Game Presidents.

Gameplay Rules for Primary Elections

Primary Elections precede Presidential Elections if the number of players are 4 or more. The winners of Primary Elections from both parties become the presidential candidates and participate in the Presidential campaign. Primary Elections allow the players to demonstrate their skills to compete as well as manifest their knowledge of American history, the U.S. Constitution and historical facts about the Presidency.

The rules for Primary Elections differ from the above Presidential Election rules that are described below:

5. If a player's token stops at a green circle, he/she collects a green—"Presidents and Historical Events" card. The player needs to answer a question on this card. If the player's answer is correct, he/she collects all the votes in the given State, otherwise he/she must pass his/her turn on to the next player.

6. If a player's token stops at a blue circle, he/she collects a blue Card—"Historical Facts about Presidents". The player needs to answer a question on this card. If the player's answer is correct, he collects all the votes in the given State, otherwise a player does not collect any votes and he/she must pass his/her turn on to the next player.

7. If a player's token stops at a red circle in a State that has already been collected by any player, the given player collects a red card: "The Constitution and the Presidency". The player needs to answer a question on this card. If the player's answer is correct, he/she can immediately get an extra turn, otherwise he must pass his/her turn on to the next player.

Winning the Primary Elections

1. While playing the game each player counts the sum of collected votes.

2. A player who has already collected 270 votes is a winner of the Primary Elections and he/she is considered as a Candidate for President.

3. If none of the players has collected 268 votes or in the case of three or more players, the player with the maximum sum of votes is declared as a winner of the primary election.

4. The player who wins the Primary Elections will continue to compete in the Presidential Elections.

Supplement Regarding the Gameplay Rules That Takes Into Account Two New Factors:

A. Candidates' Promises to the Voters During the Presidential Campaign

B. Lobbyists

This additional aspect of the game can be instructive primarily for adult players and older teenagers. This supplementary step can be invoked if the number of players is 4 or more and therefore Primary Elections have preceded the Presidential campaign. The necessary changes of the gameplay rules for the Presidential Election follows:

Changes to the following points of the Gameplay Rules for Presidential Election

7. If a candidate's token stops at a red circle in a State that has already been collected, the player draws from the deck a "Promises and Lobbyists" card (that contains the prospective bills to Congress). Obtaining this card a candidate has 3 alternatives on how to process it.

a. A candidate gives the promise to present this bill to Congress. In this event, the candidate collects this card (marked with a red sticker) and immediately gets an extra turn.

b. A candidate gives the promise to veto this bill, if it will be submitted by Congress. In this event, the candidate collects this card (marked with a blue sticker) and immediately gets an extra turn.

c. A candidate promises nothing at all. In this event, the candidate returns this card to a new lobbyists deck and must pass the turn on to the next player.

After the Electoral campaign these cards are distributed among the players (see below).

New edition of the paragraph: Winning the Game With "Promises and Lobbyists"

1. When the State card deck has been exhausted each presidential candidate counts the sum of collected votes.

2. If the Presidential candidates have ever given any promises to voters, the supplementary candidates' points should be determined. These points are determined in the following way:

3. All players of this game are considered as members of the "Presidential Electoral College". We suggest that they have their own opinions about the candidates' programs (which were expressed in the candidates' promises to voters). The U.S. Constitution provides for remedial voting in the Electoral College Convention (despite the results of the Presidential Election). Because of this, our invention proposes also to carry out the voting of the candidates' promises in the "Electoral College Convention" immediately following the completion of the Presidential Election.

4. The weight of each player in this voting is defined by his/her votes that he/she has collected during the Presidential (for presidential candidates) and Primary Elections (for all the rest of the players).

5. If there are cards in the lobbyist deck, these card should be distributed between the players before final voting. Each lobbyist card is equivalent to 5 additional votes (points). Lobbyist points are summed with the other player's votes and increase his/her electoral count. A player can utilize these cards by their own choice, voting pro or contra the bill that is represented on the "Lobbyist" card.

6. Players roll a "7–12" die. The player who obtains the maximum score draws a "Lobbyist" card from the deck by the first. Then the second does the same etc., until all cards are distributed between the players.

7. The voting at the "Electoral College Convention" is carried out sequentially for each bill that was promised by the Presidential candidates.

8. The scores for the candidates after the voting of the "Electoral College Convention" are:

a. if a candidate promised to submit a given bill to Congress and it has been approved by the "Electoral College Convention" the candidate obtains +10 points, b. if a candidate promised to submit a given bill to Congress but it has been disapproved by the "Electoral College Convention" the candidate obtains −10 points.

c. if a candidate promised to veto the given bill and it has been disapproved by the "Electoral College Convention" the candidate obtains +10 points.

d. if a candidate promised to veto the given bill but it has been approved by the "Electoral College Convention" the candidate obtains −10 points.

9. The above points are summed with the number of votes collected by the players during the Presidential Election.

10. The player who has collected the maximum number of votes and points is declared as the Game President, and his/her name is placed into the Gallery of Game Presidents.

I claim:

1. A game apparatus for two or more players comprising (a) a game board depicting a geographical map of at least one country or state divided into a plurality of geographic regions which are linked by a system of paths drawn on the background of the map;

(b) said system of paths comprising a plurality of nodal points and segments which possess such a configuration that each player has a multiple choice for landing his token on one of said nodal points;

(c) some of said nodal points being randomly positioned and classified by the categories of destination which represent steps to the player's goal to attain the required amount notes, score, and money to win the game;

(d) said segments between nodal points serve for player's token movement which is dictated by dice;

(e) a plurality of differently numbered dice which simulate player's transportation by land, by sea, and by air;

(f) a plurality of play money to provide for a predefined payment depending on which die was selected for a given turn; and (g) a plurality of instructive cards from a plurality of decks corresponding to said categories of nodal point destinations.

* * * * *